US006183215B1

(12) United States Patent
Sakai et al.

(10) Patent No.: US 6,183,215 B1
(45) Date of Patent: Feb. 6, 2001

(54) ELECTRIC MOTOR DRIVEN COMPRESSOR

(75) Inventors: Takeshi Sakai, Chiryu; Kazuhide Uchida, Nishio; Masafumi Nakashima, Anjo; Hiroyasu Kato, Kariya, all of (JP)

(73) Assignee: Denso Corporation, Kariya (JP)

( * ) Notice: Under 35 U.S.C. 154(b), the term of this patent shall be extended for 0 days.

(21) Appl. No.: 09/307,183

(22) Filed: May 7, 1999

(30) Foreign Application Priority Data

May 25, 1998 (JP) ..... 10-143242

(51) Int. Cl.[7] ..... F04B 17/00
(52) U.S. Cl. ..... 417/371
(58) Field of Search ..... 417/371

(56) References Cited

U.S. PATENT DOCUMENTS 4,850,816 * 7/1989 Kosfeld ..... 417/313
4,995,791 * 2/1991 Loprete ..... 417/366
5,222,885 * 6/1993 Cooksey ..... 418/96

FOREIGN PATENT DOCUMENTS 7-65580 7/1995 (JP) .

* cited by examiner

*Primary Examiner*—Teresa Walberg
*Assistant Examiner*—Vinod D. Patel
(74) *Attorney, Agent, or Firm*—Pillsbury Madison & Sutro LLP

(57) ABSTRACT

A compact, lightweight electric motor driven compressor suitable for an air conditioning system using a $CO_2$ refrigerant is disclosed. The thickness of a motor casing is reduced by using the gaps formed in the motor portion in a motor casing as a part of a low-pressure intake chamber, while forming a part of the discharge chamber by utilizing the annular gap between the inner surface of a pump casing and the outer surface of a compressor portion. In the case where $CO_2$ refrigerant is used, the compressor portion can be reduced in size and therefore a dead space is generated due to the difference in size with the motor casing. Since this dead space is used as a discharge chamber, the capacity of the discharge chamber can be increased to suppress the discharge pulsation.

18 Claims, 4 Drawing Sheets

ELECTRIC MOTOR DRIVEN COMPRESSOR

BACKGROUND OF THE INVENTION

1. Field of the Invention

The present invention relates to an electric motor driven compressor adapted to be used as a refrigerant compressor in an automotive air conditioning system or, in particular, to an electric motor driven compressor suitable for $CO_2$ as a refrigerant.

2. Description of the Related Art

In an air conditioning system for an electric motor driven vehicle such as an electric car or a home-use air conditioning system, it has been general practice to use freon gas, such as R134a or the like, as a refrigerant for the refrigeration cycle. Also, a refrigerant compressor used for compressing the refrigerant in the refrigeration cycle of these air conditioning systems is disclosed in JP-A-65580, for example, as what is called the "electric motor driven compressor" in which a motor portion and a compressor portion including a scroll-type compressor are integrally built in a common hermetic casing.

In the electric motor driven compressor, an intake chamber and a discharge chamber or other chambers are formed in the internal space of a casing in which the motor portion is arranged. If it is assumed that an intake chamber is formed in the internal spacing of the motor casing of an electric motor driven compressor of a conventional air conditioning system using the refrigeration cycle with the freon gas or the like as a refrigerant, generally, in the refrigeration cycle in which a flexible pipe such as a rubber hose is not used, the body or the like parts of the automotive vehicle are liable to develop noises and vibrations due to the effect of the discharge pulsation of the compressor unless the discharge chamber of the electric motor driven compressor has a sufficiently large capacity. The result would be an increased bulk of the pump portion, and a larger capacity of the discharge chamber would result in an increased bulk of the electric motor driven compressor as a whole.

In the case where the internal spacing of the motor casing is used as a discharge chamber, on the other hand, the motor casing is regarded as a pressure vessel, and therefore, a high pressure resistance value is required according to the law and regulations. Therefore, the thickness of the motor casing is required to be increased. The problem in this case is that the electric motor driven compressor would become not only bulky but also heavy. Further, in the case where carbon dioxide ($CO_2$) is used as a refrigerant, the operating pressure, i.e. the discharge pressure of the refrigerant compressor is about ten times as high as that for a freon refrigerant. This problem is therefore not negligible.

SUMMARY OF THE INVENTION

The object of the present invention is to cope with the problem of the prior art described above and to provide a compact, lightweight electric motor driven compressor whose body does not become bulky even when an intake chamber is formed in a motor casing, wherein even in the case where the thickness of the motor casing is required to be increased with the increase in the discharge pressure of the electric motor driven compressor when $CO_2$ is used as a refrigerant of the refrigeration cycle, the thickness increase is minimized thereby to prevent the weight and volume of the electric motor driven compressor from increasing.

The present inventors have taken note of the fact that the operating pressure in the refrigeration cycle using the $CO_2$ refrigerant, i.e. the discharge pressure of the refrigerant compressor, is very high as compared with the corresponding pressure in the refrigeration cycle using freon as a refrigerant, so that the intake volume of the refrigerant compressor for the $CO_2$ refrigerant is as small as about one eighth of the volume of the compressor for the freon refrigerant, and the resulting smaller volume of the compressor portion creates a dead space around the compressor portion due to the difference in body size between the small compressor portion and the motor casing of a normal size.

The dead space is utilized by forming a discharge chamber having a comparatively large volume around the compressor portion, and an intake chamber is formed using the large space in the motor casing. In this way, the space can be reduced to a comparatively low pressure, and the thickness of the motor casing can be decreased. Thus, while minimizing the effect of the discharge pulsation, the body size of the electric motor driven compressor as a whole is reduced. Specifically, as a means for solving the problem mentioned above, there is provided an electric motor driven compressor having a configuration as described in each claim.

In the electric motor driven compressor according to claim 1, at least a part of the intake chamber is formed by the gaps between the component parts of the motor portion in the motor casing, and therefore a sufficiently large volume can be secured as an intake chamber. At the same time, since the intake chamber is a component where the pressure is lowest in the system (refrigeration cycle) including the electric motor driven compressor, the thickness of the motor casing can be reduced resulting in a lighter weight of the electric motor driven compressor. Also, the discharge chamber is formed by the gap between the inner surface of the pump casing and the compressor portion mounted in the pump casing. Therefore, the volume of the discharge chamber can be increased by utilizing the dead space which is increased with the difference in size between the motor casing and the compressor portion when the latter is miniaturized, thereby the discharge pulsation is effectively suppressed.

If it is assumed that the interior of the motor casing is used as a discharge chamber, an expensive shaft seal portion such as a mechanical seal would be required on the part passing through the boundary surface around the shaft extending from within the motor casing constituting a high-pressure space through the boundary surface to the low-pressure space such as the intake chamber in the pump casing. According to the present invention, however, the interior of the motor casing constitutes an intake space, and therefore the shaft extends from the low-pressure intake space in the motor casing to the low-pressure space such as the intake chamber in the pump casing. Since there is no substantial pressure difference between the intake space in the motor casing and the intake chamber in the pump casing, a shaft seal portion is not required at the boundary surface through which the shaft is laid. This remarkably reduces the cost. Also, since the motor portion in the motor casing is sufficiently cooled by the returning refrigerant, the efficiency of the whole system is improved. Also, since the interior of the motor casing constitutes an intake space at a comparatively low pressure, the required degree of super-heat of the return refrigerant can be secured and the return of a liquid refrigerant is prevented in the case where this electric motor driven compressor is used as a refrigerant compressor in the refrigeration cycle, or especially, in the accumulator cycle of the air conditioning system. Thus, the system reliability is improved.

In the electric motor driven compressor according to claim 2, an intermediate member can be utilized not only as a bearing support of the shaft but also as a partitioning plate between the intake chamber and the discharge chamber.

In the electric motor driven compressor according to claim 3 or 4, the discharge chamber assumes a cylindrical shape, while in the electric motor driven compressor according to claim 5 or 6, the discharge chamber assumes the shape of a bottomed cylinder.

The electric motor driven compressor according to one of claim 7 to 12 is used as a refrigerant compressor for compressing the $CO_2$ refrigerant in the air conditioning system. In the case where the cooling effect equivalent to the freon refrigerant can be secured, therefore, the discharge pressure is increased while the discharge rate is reduced to about one eighth. Therefore, the compressor portion can be considerably reduced in size. As a result, the volume of the discharge chamber formed between the pump casing and the compressor portion can be sufficiently increased simply by utilizing the dead space due to the body size difference between the motor casing and the compressor portion. Thus, the electric motor driven compressor is reduced in size and weight as a whole, while the discharge chamber is enlarged for an effective suppression of the discharge pulsation.

In the electric motor driven compressor according to one of claims 13 to 18, the optimum type can be selected from among at least a scroll-type compressor, a vane-type refrigerant compressor and a piston-type refrigerant compressor.

According to the present invention, there is provided a compact, lightweight electric motor driven compressor having the same performance as a conventional compressor. In a system using an electric motor driven compressor, a flexible pipe such as a rubber hose is not generally used for connection. When the electric motor driven compressor is mounted directly on the chassis of the automotive vehicle, therefore, the vibration and noise due to the discharge pulsation are liable to propagate to the cabin. According to this invention, however, the volume of the discharge chamber can be increased without increasing the size of the whole system, and therefore the discharge pulsation is effectively reduced to reduce the vibration and noise propagating to the cabin.

BRIEF DESCRIPTION OF THE DRAWINGS

The above and other objects, features and advantages will be made apparent by the detailed description taken in conjunction with the accompanying drawings, in which.

DESCRIPTION OF THE PREFERRED EMBODIMENTS

Figure 1:
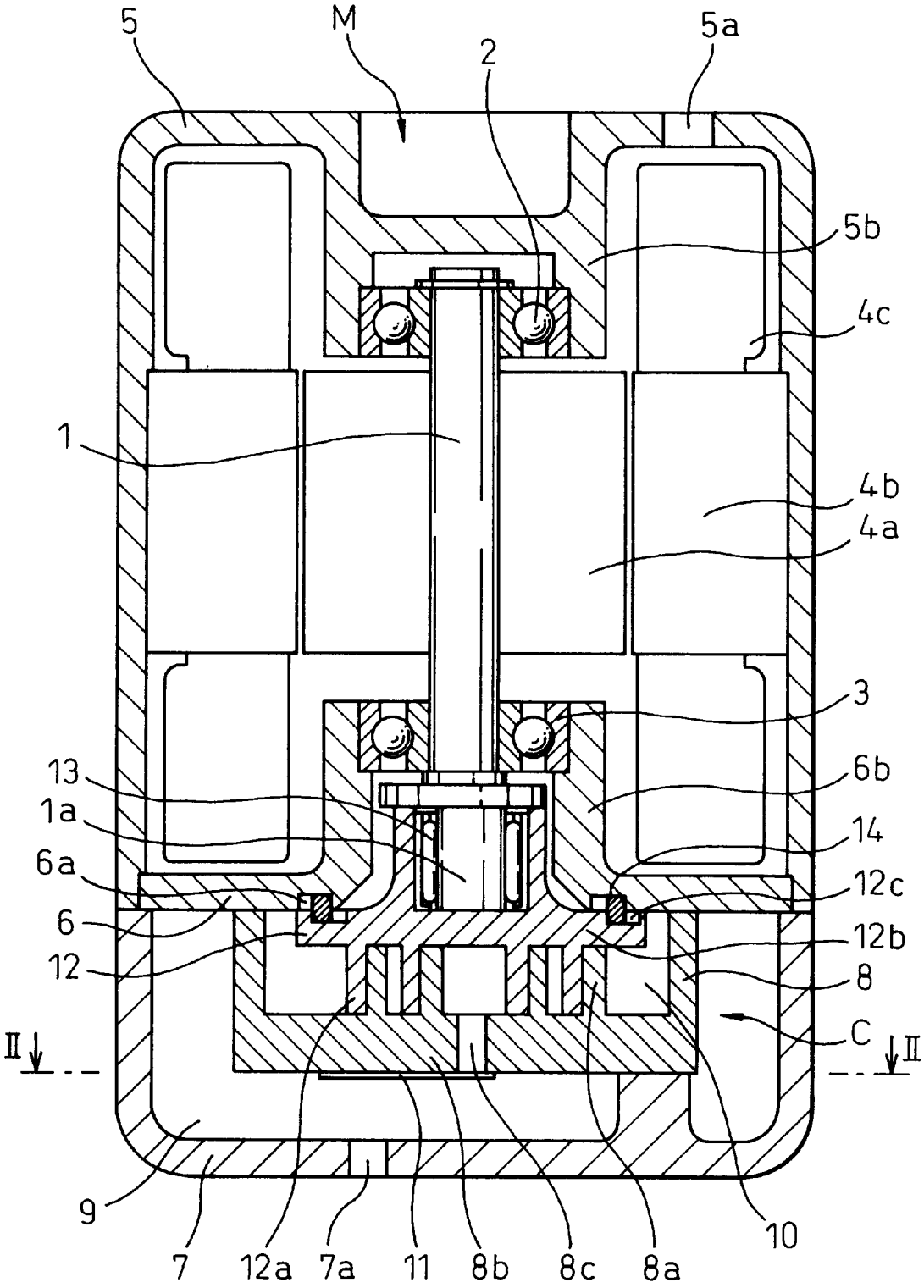
FIG. 1 is a longitudinal sectional view of a scroll-type compressor according to a first embodiment of the present invention.

FIG. 1 shows a sectional structure of a scroll-type compressor according to a first embodiment of the invention. Numeral 1 designates a shaft constituting the central portion supported by a front bearing 2 and a rear bearing 3. Character M designates a motor portion M in general. The motor portion M includes a motor rotor 4*a* mounted on the rotatable shaft 1, a fixed motor stator 4*b*, and a motor coil 4*c* constituting a part of the motor stator 4*b*. The motor stator 4*b* is fixed in a motor casing 5. The motor casing 5 is protruded inward cylindrically at the central part at one end thereof, where a support 5*b* of the front bearing 2 is formed. Also, an intake port 5*a* is opened at the same end of the motor casing 5, whereby a large spacing including the gap between the motor rotor 4*a* and the motor stator 4*b* in the motor casing 5 constitutes the portion upstream of an intake chamber 10 described later.

The whole of the other end of the motor casing 5 forms a large opening, and a generally circular intermediate member 6 is mounted in such a manner as to close the opening. The central portion of the intermediate member 6 is cylindrically protruded inward of the motor M, and constitutes a support 6*b* for mounting the rear bearing 3 as described above. According to the first embodiment, a scroll-type compressor is mounted as a compressor portion C at the other end of the intermediate member 6. A plurality of pockets 6*a* constituting circular holes for limiting the movable range of an anti-rotation pin 14 (described later) are arranged on the surface of the other end of the intermediate member 6.

The motor casing 5 and the intermediate member 6 are integrally fastened to a pump casing 7 by a through bolt or the like not shown. According to the first embodiment shown in FIG. 1, a shell 8 of the scroll-type compressor constituting the compressor portion C is fixedly held between intermediate member 6 and a protrusion formed in the pump casing 7. In this way, the pump casing 7 surrounds the outer periphery of the shell 8 of the compressor portion C from outside, with a normally useless gap corresponding to a dead space. Thus, a cylindrical discharge chamber 9 for the compressor portion C is formed in the pump casing 7 outside of the shell 8. Further, in the case where a gap is formed between the lower end surface in axial direction of the shell 8 and the bottom surface of the pump casing 7 as a part of the discharge chamber 9, a cup-shaped cylindrical, bottomed discharge chamber 9 with a large volume is formed. In all of these cases, a discharge port 7*a* is provided at an appropriate point on the lower end surface of the pump casing 7.

According to the first embodiment, the compressor portion C is constituted as a scroll-type compressor, and therefore like the well-known scroll-type compressor, a shell blade portion 8*a* as a spiral blade is formed in the fixed shell 8. The space outside of the shell blade portion 8*a* forms an intake chamber 10 communicating, through a path not shown, with the space formed in the gap in the motor portion M described above. It also communicates with the intake port 5*a* through the same space. The intake port 5*a* is connected to the evaporator in the refrigeration cycle of the air conditioning system by a pipe not shown. Also, a discharge hole 8*c* is opened at the central portion of the shell end plate 8*b*. A discharge valve 11 like a reed valve is arranged in such a position to cover the discharge hole 8*c* from outside. The discharge port 7*a* of the discharge chamber 9 is connected to a condenser in the refrigeration cycle of the air conditioning system by a pipe not shown.

According to the first embodiment, the compressor portion C is configured as a scroll-type compressor, and therefore the shell 8 has a rotor 12 therein. The rotor end plate 12*b* of the rotor 12 engages the crank pin la formed eccentrically at the lower end of the shaft 1 through the crank bearing 13, and driven rotationally by the crank pin la. The rotor end plate 12*b* is formed with a spiral rotor blade portion 12*a* engaging the shell blade 8*a*. In order to prevent the rotation of the rotor 12, a plurality of rotor pockets 12*c* constituting circular holes are formed in the surface of the rotor end plate 12*b* slidably in contact with the intermediate member 6. An anti-rotation pin 14 is held between each of the rotor pockets 12*c* and a corresponding pocket 6*a* of the intermediate member 6.

Figure 2A:
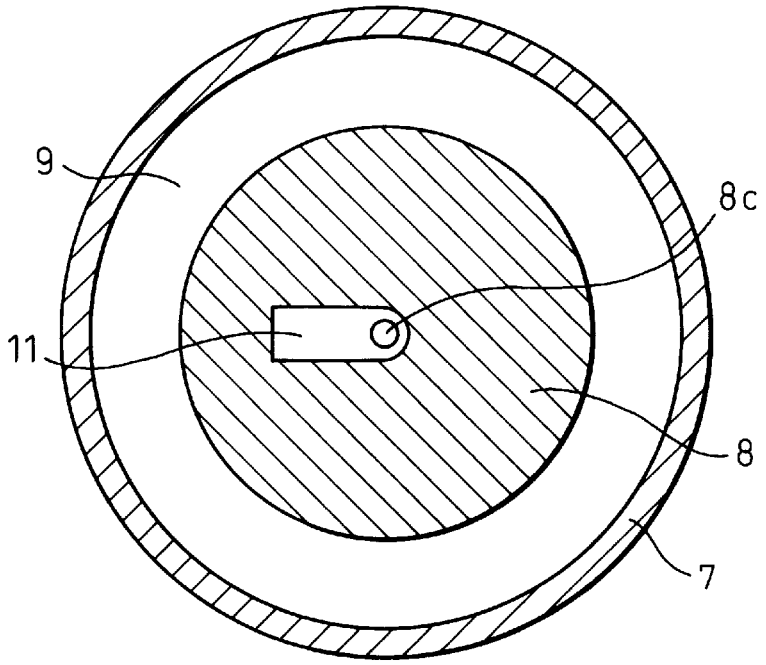
FIG. 2A is a cross sectional view of the shell end of a scroll-type compressor according to the first embodiment.

FIG. 2A is a cross sectional view of the pump casing 7 and the shell end plate 8*b* of FIG. 1. According to the first embodiment, the $CO_2$ refrigerant is used, and therefore, as compared with the case of using freon refrigerant, the same cooling capacity can be produced by a discharge capacity as small as about one eighth. Thus, the compressor portion C can be considerably reduced in size, with the result that a large dead space is created around the shell 8 due to the difference in body size compared to the motor portion M of normal size. According to this invention, the dead space is utilized as a discharge chamber 9, and therefore the discharge chamber 9 having a sufficiently large capacity is formed as compared with the compressor portion C, thereby making it possible to effectively smooth the discharge pulsation of the compressor portion C.

Figure 2B:
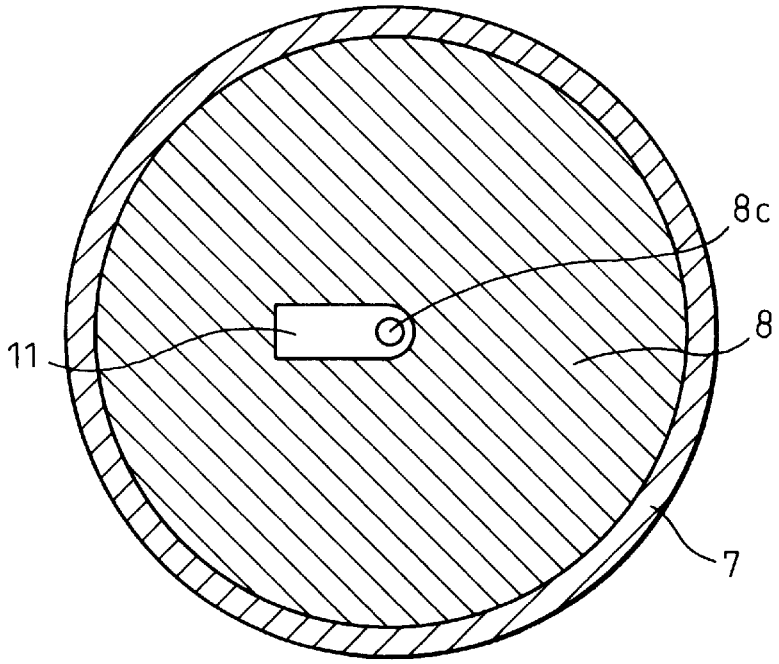
Fig. 2B PRIOR ART
FIG. 2B is a cross sectional view of the shell end of a conventional scroll-type compressor.

When the freon refrigerant is used as in the prior art, in contrast, as shown in FIG. 2B, the shell 8 of the compressor portion C increases in size and the discharge chamber 9 cannot be formed around the shell 8. Assuming that the outer diameter of the discharge chamber 9 is about the same as that of the compressor portion C, therefore, only the discharge chamber 9 of a comparatively small size can be formed axially outside of the shell end plate 8*b*. The reduced size of the discharge chamber 9 increases the discharge pulsation of the refrigerant discharged into the refrigeration cycle. If a discharge chamber 9 of large capacity having an outer diameter larger than that of the intake chamber 10 or the motor casing 5 is formed as a countermeasure, the whole size of the refrigerant compressor is unavoidably increased.

The first embodiment is configured as shown in FIGS. 1 and 2A. Upon rotation of the shaft 1 by supplying power to the motor portion M, the rotor end plate 12*b* is rotationally driven by the eccentric crank pin la, while at the same time stopping the rotation of the rotor end plate 12*b* by the anti-rotation pin 14. The rotor 12 thus orbits around the center axis of the shaft 1. The working chamber formed between the rotor blade 12*a* and the shell blade portion 8*a* of the shell 8 engaging it functions in such a way that the $CO_2$ refrigerant, introduced the moment the working chamber opens toward the intake chamber 10 on the outer periphery thereof, is compressed as the volume is reduced when the working chamber is closed and moves gradually toward the center. The $CO_2$ refrigerant thus compressed passes from the working chamber at the center through the discharge hole 8*c*, pushes open the discharge valve 11 and is discharged into the discharge chamber 9.

A bottomed cylindrical (cup-shaped) discharge chamber 9 having a large volume is formed in the dead space around the shell 8 of the compressor portion C reduced in size by use of the $CO_2$ refrigerant to the end of the shell 8. Thus, the discharge pulsation is positively smoothed, and the refrigerant continuously flows with small discharge pulsation into the condenser of the refrigeration cycle. Thus, the vibration and noise are not generated by the discharge pulsation.

A sufficiently large intake chamber space is formed by the upstream portion of the intake chamber formed by the gaps between the motor rotor 4*a*, the motor stator 4*b*, the motor coil 4*c*, etc. making up the motor portion M in the motor casing 5 on the one hand and the intake chamber 10 in the pump portion C communicating with the gaps on the other hand. Therefore, the discharge pulsation of the $CO_2$ refrigerant that has returned from the evaporator of the refrigeration cycle is further smoothed. According to the first embodiment, although the refrigeration cycle uses $CO_2$ refrigerant, the intake chamber space is lowest in pressure in the refrigeration cycle, and the internal pressure of the motor casing is comparatively low. Therefore, the motor casing 5 need not be thick. Thus, according to this invention, not only the motor casing 7 need not be increased in size specially for the discharge chamber 9, but also both the size and weight of the whole compressor can be reduced for a smaller size and weight of the refrigerant compressor.

Figure 3:
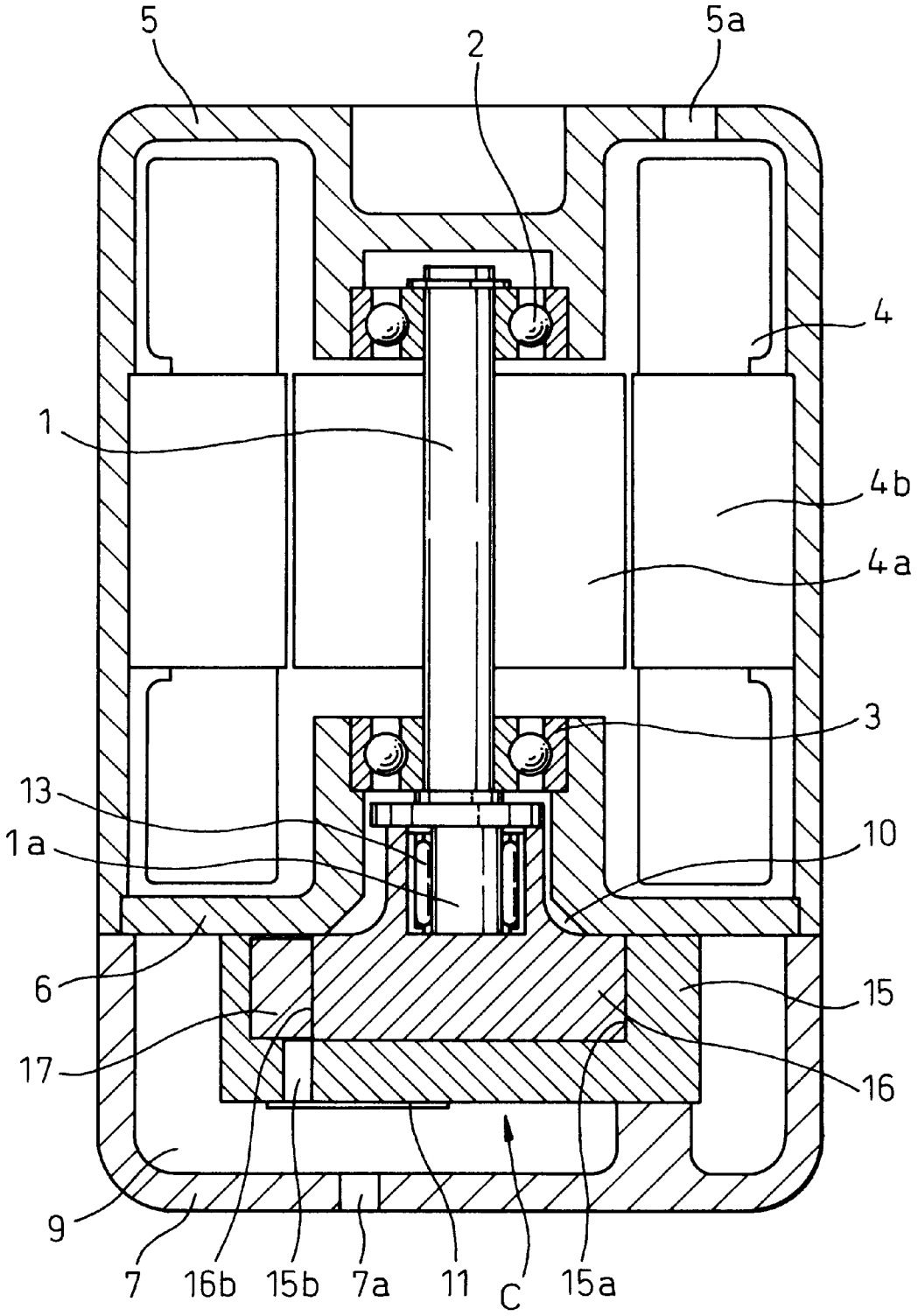
FIG. 3 is a longitudinal sectional view showing a vane-type refrigerant compressor according to a second embodiment of the invention.

FIG. 3 shows a structure of a vane-type refrigerant compressor according to a second embodiment of the invention. Substantially the same component parts as the corresponding parts in the scroll-type compressor shown in FIG. 1 are designated by the same reference numerals, respectively, and will not be described. In the second embodiment, the structure of the motor portion M is the same as that in the first embodiment of FIG. 1. The feature of the second embodiment, however, lies in that the vane-type refrigerant compressor has a somewhat different structure of the compressor portion C. The compressor portion C according to the second embodiment may have the same structure as the well-known vane-type refrigerant compressor. Therefore, only the essential parts of the compressor portion C will be explained.

A rotor 16 comparatively small in diameter is inserted, at a position eccentric from the center line of the shaft 1, in the circular space 15*a* of the stator 15 mounted between the intermediate member 6 and the pump casing 7. The rotor 16, when rotationally driven through the crank bearing 13 by the crank pin la of the shaft 1, oscillates while orbiting within the circular space 15*a*. The rotation of the rotor 16 is inhibited by the anti-rotation mechanism not shown. The rotor 16 is formed with a substantially radial groove 16*b* for the vane, into which a tabular vane 17 is inserted in a manner movable in radial direction. The tabular vane 17 thus is urged radially outward by a spring or the like not shown and kept in contact with the cylindrical surface of the circular space 15*a*. Alternatively, the vane 17 may be inserted movably in a groove formed in radial direction in the stator 15 while being kept in contact with the cylindrical surface on the outer periphery of the rotor 16.

The eccentric motion of the crank pin la with the rotation of the shaft 1 forcibly causes the oscillation of the rotor 16 through the crank bearing 13. The crescent space formed between the inner cylindrical wall of the circular space 15*a* of stator 15 and the outer periphery of the rotor 16 is partitioned into front and rear chambers by the vane 17. An intake hole, not shown, is formed in the intermediate member 6 to communicate one of these chambers with the interior of the motor casing 5 and the intake port 5*a*, and a discharge hole 15*b* adapted for communicating the other chamber with the discharge chamber 9 is formed at a predetermined position near the outer periphery of the stator 15. This discharge hole 15*b* is closed from outside by the discharge valve 11. Then, when one of the chambers of the vane 17 increases in volume with the oscillation of the rotor 16, the incoming refrigerant is introduced from the intake port 5*a*. The refrigerant is compressed when the particular chamber is reduced in size, and moves to the other chamber. Thus, the discharge valve 11 is pushed open, and the refrigerant is discharged from the discharge hole 15*b* into the discharge chamber 9.

The other operation is substantially identical to that for the first embodiment. The compressor portion C according to the second embodiment, therefore, operates substantially the same way as a pump as in the first embodiment and has a similar function and effect to the first embodiment.

Figure 4:
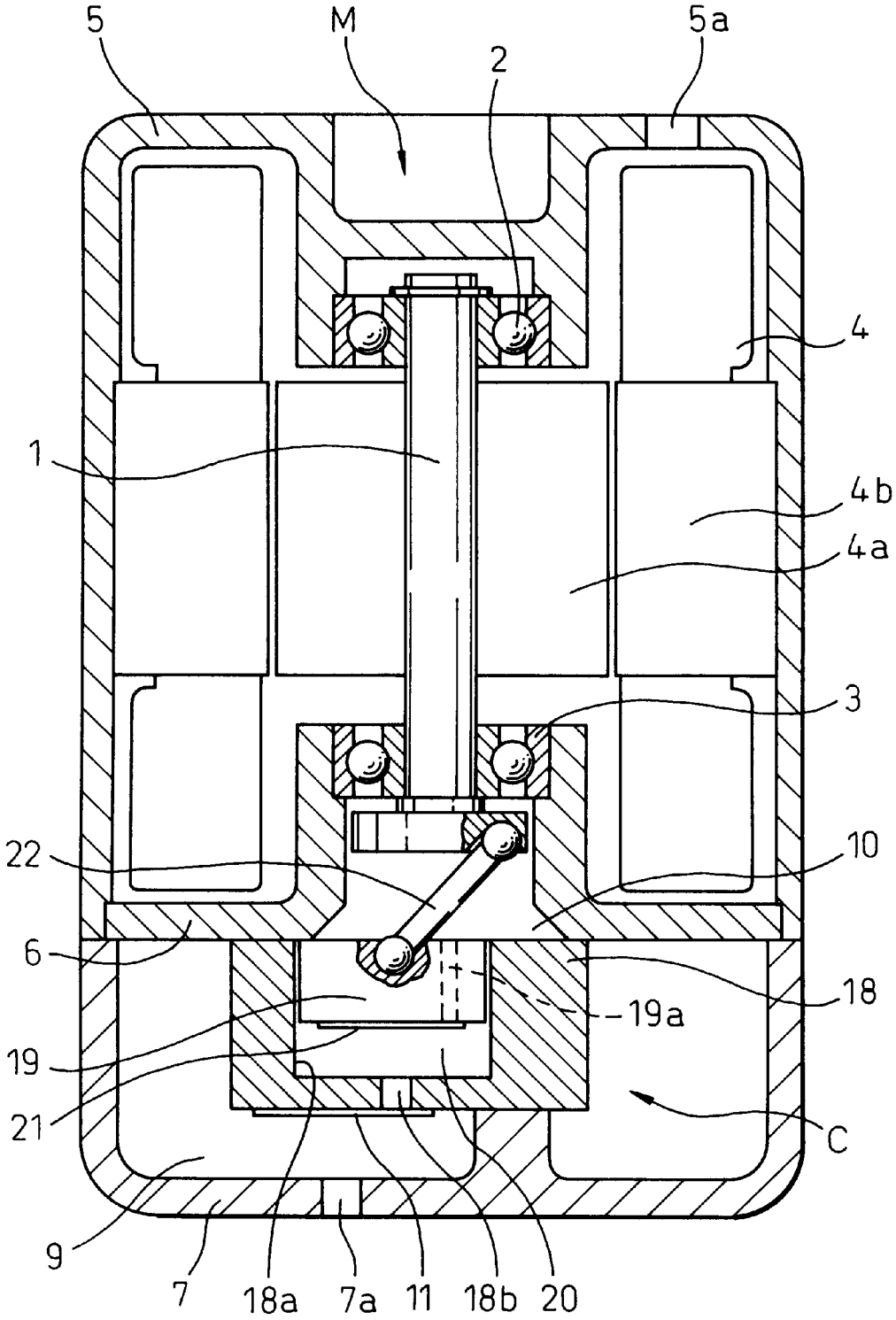
FIG. 4 is a longitudinal sectional view showing a piston-type refrigerant compressor according to a third embodiment of the invention.

FIG. 4 shows the structure of a piston-type refrigerant compressor according to a third embodiment of the invention. The component elements substantially similar to those of the scroll-type compressor of FIG. 1 or the vane-type refrigerant compressor of FIG. 3 are designated by the same reference numerals, respectively, and will not be described again. In the third embodiment, the motor portion M has the same structure as the first embodiment shown in FIG. 1 and the second embodiment shown in FIG. 3. The feature of the third embodiment, however, lies in that the piston-type refrigerant compressor has a somewhat different structure of the compressor portion C. The compressor portion C according to the third embodiment, however, may have the same structure as the well-known piston-type refrigerant compressor. Therefore, only the essential parts of the structure will be explained.

The cylinder block 18 mounted at a position eccentric with respect to the axial center of the shaft 1 between the intermediate member 6 and the pump casing 7 is formed with a cylinder 18*a*, into which a cylindrical piston 19 is slidably inserted. The motion of the piston 19 forms a working chamber 20 with a changing volume in the cylinder 18*a*. The intake hole 19*a* adapted for communicating the intake chamber 10 constituting a space above the piston 19 with the working chamber 20 constituting a space below the piston 19 is formed through the piston 19, and an intake valve 21 is arranged on the surface of the working chamber 20 side thereof. Also, the discharge hole 18*b* adapted for communicating the working chamber 20 with the discharge chamber 9 is formed at the lower end surface of the cylinder block 18, and the discharge valve 11 is mounted on the surface of the discharge hole 18*b* on the discharge chamber 9 side. In order to reciprocate the piston 19 vertically in the cylinder 18*a*, the lower end of the shaft 1 and the piston 19 are coupled by a connecting rod 22 having a ball joint at the ends thereof.

With the rotation of the shaft 1 rotationally driven by the motor portion M, the piston 19 reciprocates vertically in the cylinder 18*a* through the action of the connecting rod 22. When the piston 19 moves up, the volume of the working chamber 20 increases, so that the intake valve 21 opens and the low-pressure refrigerant is introduced into the working chamber 20 from the intake chamber 10. When the piston 19 moves down, on the other hand, the volume of the working chamber 20 decreases and the intake valve 21 closes. Thus, the refrigerant in the working chamber 20 is compressed, pushes open the discharge valve 11 and is discharged from the discharge hole 18*b* into the discharge chamber 9.

In the third embodiment, the subsequent operation is the same as that of the first and second embodiments, and therefore substantially the same function and effect are obtained as in the first and second embodiments.

The present invention is not confined to the embodiments described in detail above and shown in the accompanying drawings, but can of course be embodied otherwise, by those skilled in the art, without departing from the scope described in the claims.

What is claimed is:

1. An electric motor driven compressor comprising a motor portion accommodated in a motor casing, and a compressor portion accommodated in a pump casing integrated with said motor casing and driven by said motor portion, wherein at least a part of the intake chamber is formed by the gaps between the component parts of the motor portion in said motor casing, and wherein at least a part of the discharge chamber is formed by the gap between the inner surface of said pump casing and the outer surface of said compressor portion mounted in said pump casing.

2. An electric motor driven compressor according to claim 1, further comprising an intermediate member as a partitioning plate between said motor portion and said compressor portion, said intermediate member being integrally coupled with said motor casing and said pump casing therebetween, wherein said intermediate member supports one of the bearings supporting the shaft of the motor portion, and also acts as a partitioning plate between said intake chamber in said motor casing and said discharge chamber in said pump casing.

3. An electric motor driven compressor according to claim 2, wherein said discharge chamber is formed by the gap between the outer peripheral surface of said compressor portion and the inner surface of said pump casing so that said discharge chamber is cylindrical in shape.

4. An electric motor driven compressor according to claim 3, wherein said discharge chamber is formed by the gap between the outer peripheral surface and one of the axial end surfaces of said compressor portion and the inner surface of said pump casing so that said discharge chamber is in the shape of a bottomed cup.

5. An electric motor driven compressor according to any one of claim 4, used as a refrigerant compressor in the refrigeration cycle of an air conditioning system and, especially, used for compressing carbon dioxide as a refrigerant.

6. An electric motor driven compressor according to any one of claim 5 wherein said compressor portion is a vane-type refrigerant compressor.

7. An electric motor driven compressor according to any one of claim 3, used as a refrigerant compressor in the refrigeration cycle of an air conditioning system and, especially, used for compressing carbon dioxide as a refrigerant.

8. An electric motor driven compressor according to any one of claim 2, used as a refrigerant compressor in the refrigeration cycle of an air conditioning system and, especially, used for compressing carbon dioxide as a refrigerant.

9. An electric motor driven compressor according to any one of claim 2, wherein said compressor portion is a scroll-type compressor.

10. An electric motor driven compressor according to any one of claim 2, wherein said compressor portion is a piston-type refrigerant compressor.

11. An electric motor driven compressor according to claim 1, wherein said discharge chamber is formed by the gap between the outer peripheral surface of said compressor portion and the inner surface of said pump casing so that said discharge chamber is cylindrical in shape.

12. An electric motor driven compressor according to claim 11, wherein said discharge chamber is formed by the gap between the outer peripheral surface and one of the axial end surfaces of said compressor portion and the inner surface of said pump casing so that said discharge chamber is in the shape of a bottomed cup.

13. An electric motor driven compressor according to any one of claim 12, used as a refrigerant compressor in the refrigeration cycle of an air conditioning system and, especially, used for compressing carbon dioxide as a refrigerant.

14. An electric motor driven compressor according to any one of claim 11, used as a refrigerant compressor in the refrigeration cycle of an air conditioning system and, especially, used for compressing carbon dioxide as a refrigerant.

15. An electric motor driven compressor according to any one of claim 1, used as a refrigerant compressor in the refrigeration cycle of an air conditioning system and, especially, used for compressing carbon dioxide as a refrigerant.

16. An electric motor driven compressor according to any one of claim 1, wherein said compressor portion is a scroll-type compressor.

17. An electric motor driven compressor according to any one of claim 1, wherein said compressor portion is a vane-type refrigerant compressor.

18. An electric motor driven compressor according to any one of claim 1, wherein said compressor portion is a piston-type refrigerant compressor.

* * * * *